US008690400B2

(12) United States Patent
Foltz et al.

(10) Patent No.: US 8,690,400 B2
(45) Date of Patent: Apr. 8, 2014

(54) HOLDING STRUCTURE FOR LIGHT SOCKET

(75) Inventors: Peter M. Foltz, Golden Valley, MN (US); Laszlo Titkos, Shoreview, MN (US); Jacob Strassburger, South Plainfield, NJ (US)

(73) Assignee: Target Brands, Inc., Minneapolis, MN (US)

( * ) Notice: Subject to any disclaimer, the term of this patent is extended or adjusted under 35 U.S.C. 154(b) by 502 days.

(21) Appl. No.: 13/172,613

(22) Filed: Jun. 29, 2011

(65) Prior Publication Data

US 2013/0003394 A1 Jan. 3, 2013

(51) Int. Cl.
*B65D 85/00* (2006.01)

(52) U.S. Cl.
USPC ..... 362/457; 362/458

(58) Field of Classification Search
USPC ..... 362/457, 458; 206/736, 439, 216, 273, 206/378, 701; 439/148
See application file for complete search history.

(56) References Cited

U.S. PATENT DOCUMENTS

| | | | | |
|---|---|---|---|---|
| 794,140 | A | 7/1905 | Costa | |
| 1,783,453 | A | 12/1930 | Reisert | |
| 2,983,368 | A | 5/1961 | Lugt | |
| 3,158,261 | A * | 11/1964 | Stiffel | 206/320 |
| 3,162,308 | A | 12/1964 | Whiteford | |
| 3,408,758 | A | 11/1968 | Doring | |
| 4,099,612 | A * | 7/1978 | Hanson | 206/783 |
| 4,128,171 | A * | 12/1978 | Evans | 206/320 |
| 4,197,808 | A | 4/1980 | Kinninger | |
| 4,549,654 | A | 10/1985 | Tiesman | |
| 4,702,374 | A | 10/1987 | Keiner | |
| 5,392,919 | A | 2/1995 | Passamoni | |
| 5,695,059 | A | 12/1997 | Reich | |
| 6,032,797 | A | 3/2000 | Kao | |
| 6,325,209 | B1 * | 12/2001 | Humphrey | 206/320 |
| 6,419,085 | B1 * | 7/2002 | Humphrey | 206/320 |
| 6,854,594 | B2 | 2/2005 | Vasudeava et al. | |
| 7,427,204 | B1 | 9/2008 | Mangone | |
| 7,513,071 | B2 | 4/2009 | Miyake | |
| 7,621,405 | B2 | 11/2009 | Schweitzer et al. | |
| 2002/0125163 | A1 * | 9/2002 | Chou | 206/418 |
| 2008/0261421 | A1 | 10/2008 | Wiser | |
| 2010/0051676 | A1 | 3/2010 | Stoelting | |
| 2010/0227488 | A1 | 9/2010 | Lau | |

* cited by examiner

*Primary Examiner* — Laura Tso
(74) *Attorney, Agent, or Firm* — Theodore M. Magee; Westman, Champlin & Koehler, P.A.

(57) ABSTRACT

A lamp assembly includes a base and a lamp socket supported by the base. The lamp socket has a cylindrical inner surface with screw threads formed thereon. A lamp holder has a socket portion and an arm portion. A lower part of the socket portion is inserted within the lamp socket and is held in place by the screw threads of the lamp socket. The arm portion extends laterally from an upper part of the socket portion. A lamp package containing a lamp at least partially encased in packaging is attached to the arm portion of the lamp holder.

20 Claims, 9 Drawing Sheets

HOLDING STRUCTURE FOR LIGHT SOCKET

BACKGROUND

Lamp assemblies, often referred to as table lamps or floor lamps, are typically shipped from the manufacturer without a light bulb because light bulbs are susceptible to damage during the shipping process. As a result, either retailers must add the light bulb to the lamp assembly when the lamp assembly reaches their store or the consumer must purchase a light bulb separately from the lamp assembly.

The discussion above is merely provided for general background information and is not intended to be used as an aid in determining the scope of the claimed subject matter.

SUMMARY

A lamp assembly includes a base and a lamp socket supported by the base. The lamp socket has a cylindrical inner surface with screw threads formed thereon. A lamp holder has a socket portion and an arm portion. A lower part of the socket portion is inserted within the lamp socket and is held in place by the screw threads of the lamp socket. The arm portion extends laterally from an upper part of the socket portion. A lamp package containing a lamp at least partially encased in packaging is attached to the arm portion of the lamp holder.

A lamp holder includes a socket latching component shaped to be pressed into a lamp socket such that threads within the lamp socket hold the socket latching component in place. An arm extends from the socket latching component and is capable of supporting a lamp package containing a lamp designed to operate in the lamp socket.

A method includes steps of receiving a packaged lamp assembly comprising packaging around at least a portion of a lamp assembly. The lamp assembly is removed from the packaging of the packaged lamp assembly, where the lamp assembly includes a lamp base, a lamp socket, a lamp holder inserted in the lamp socket, and a lamp package. The lamp holder includes at least one arm and the lamp package is connected to at least one arm of the lamp holder. The lamp assembly is displayed in a retail space while maintaining the connection between the lamp package and the arm of the lamp holder so that the lamp assembly, including the lamp package, may be purchased.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

In some parts of the world, regulations have been passed to increase the use of Compact Fluorescent Bulbs (CFLs). In one such regulation, retailers of lamp assemblies such as table lamps and floor lamps are required to sell a CFL along with the lamp assembly. However, due to the fragility of CFLs, packaging a CFL with a lamp assembly so that the CFL does not break while at the same time minimizing the cost of the lamp assembly is a substantial challenge to the lighting industry.

The present inventors have created a holding structure that can be pressed into a lamp socket of a lamp assembly and that can support one or more items. The holding structure includes structural elements that interact with the screw threads found in most lamp sockets such that the holding structure resists being pulled out of the lamp socket. In accordance with some embodiments, the holding structure includes one or more arms. In accordance with one particular embodiment, the holding structure includes a long arm designed to support a lamp package that is connected to an end of the arm and a short arm designed to support a portion of an electrical cord connected to the end of the short arm. The holding structure is designed to be pressed into the lamp socket so that it can be quickly assembled and correctly positioned in the lamp socket, but is designed to be unscrewed from the lamp socket to thereby make it more difficult to remove the holding structure from the lamp socket.

In this application the following terms are used:

Lamp—A light emitting element that may be inserted into a lamp assembly so as to be supported by the lamp assembly and so as to receive power from the lamp assembly. The term lamp covers many types of light emitting elements including light bulbs, fluorescent bulbs, Light Emitting Diodes (LEDs) and LED assemblies, for example. Within this application, the term "lamp" by itself, does not refer to structures used to support light emitting elements.

Lamp Assembly—A structure used to support and provide power to a light emitting element. Lamp assemblies include structures such as table lamps, floor lamps, chandeliers, sconces, track lighting, and recess lighting, for example. The lamp assembly may include, for example, a base, a pole extending from the base, a lamp socket, a power cord, a shade support, a shade and additional elements attached to or supported by one or more of these elements.

Figure 1:
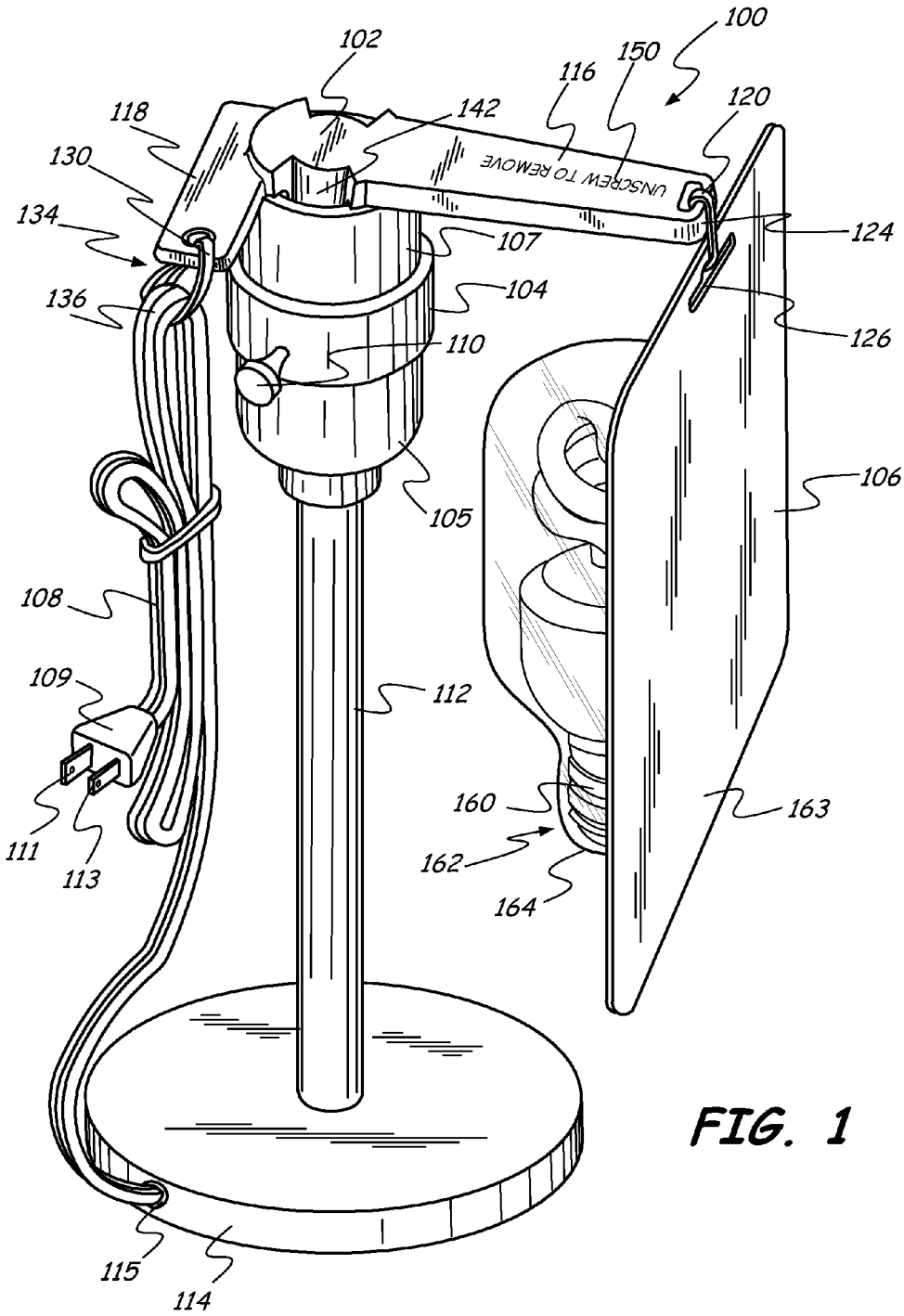
FIG. 1 is a front view of a lamp assembly with a holding structure.
Figure 2:
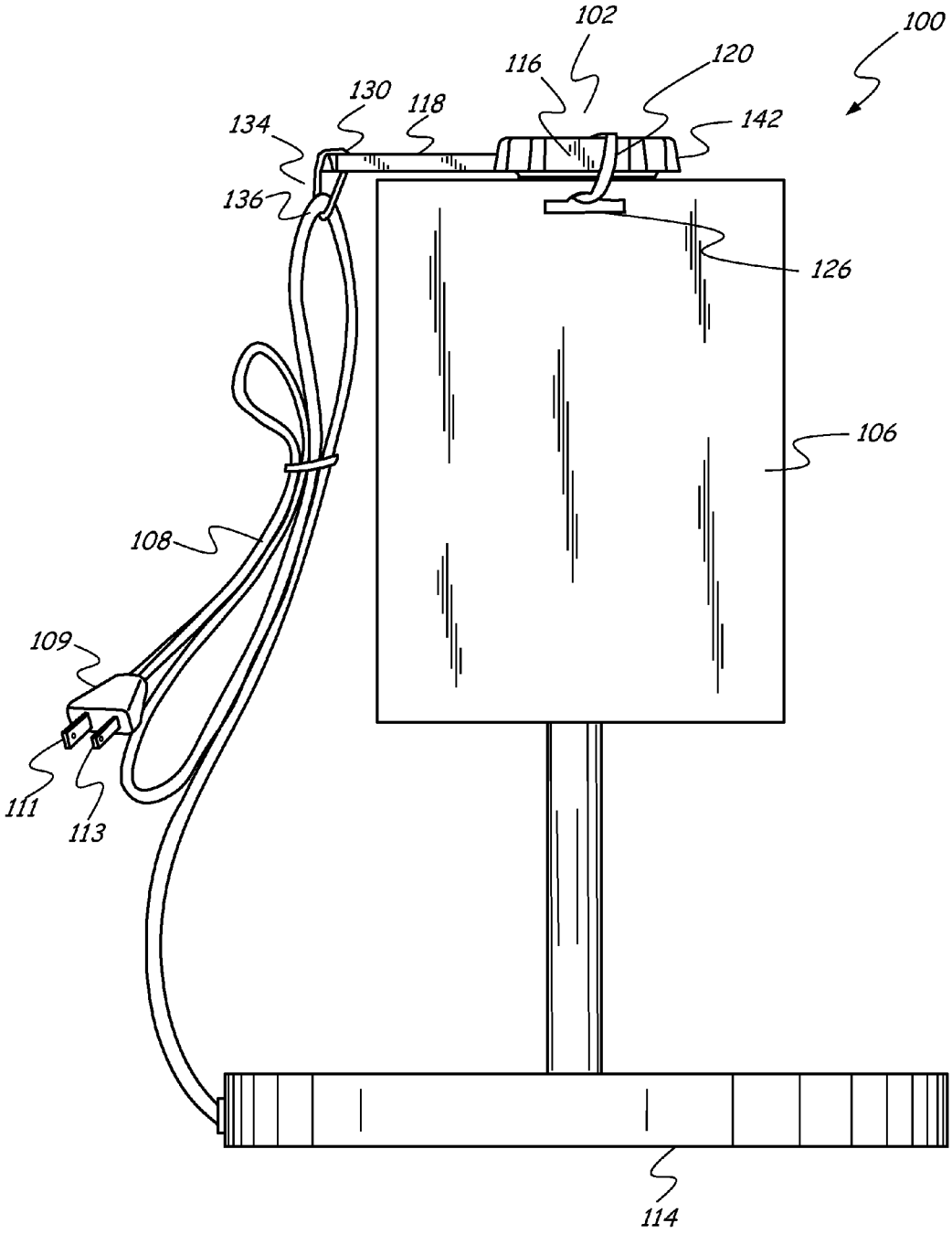
FIG. 2 is side view of the lamp assembly with holding structure of FIG. 1.
Figure 3:
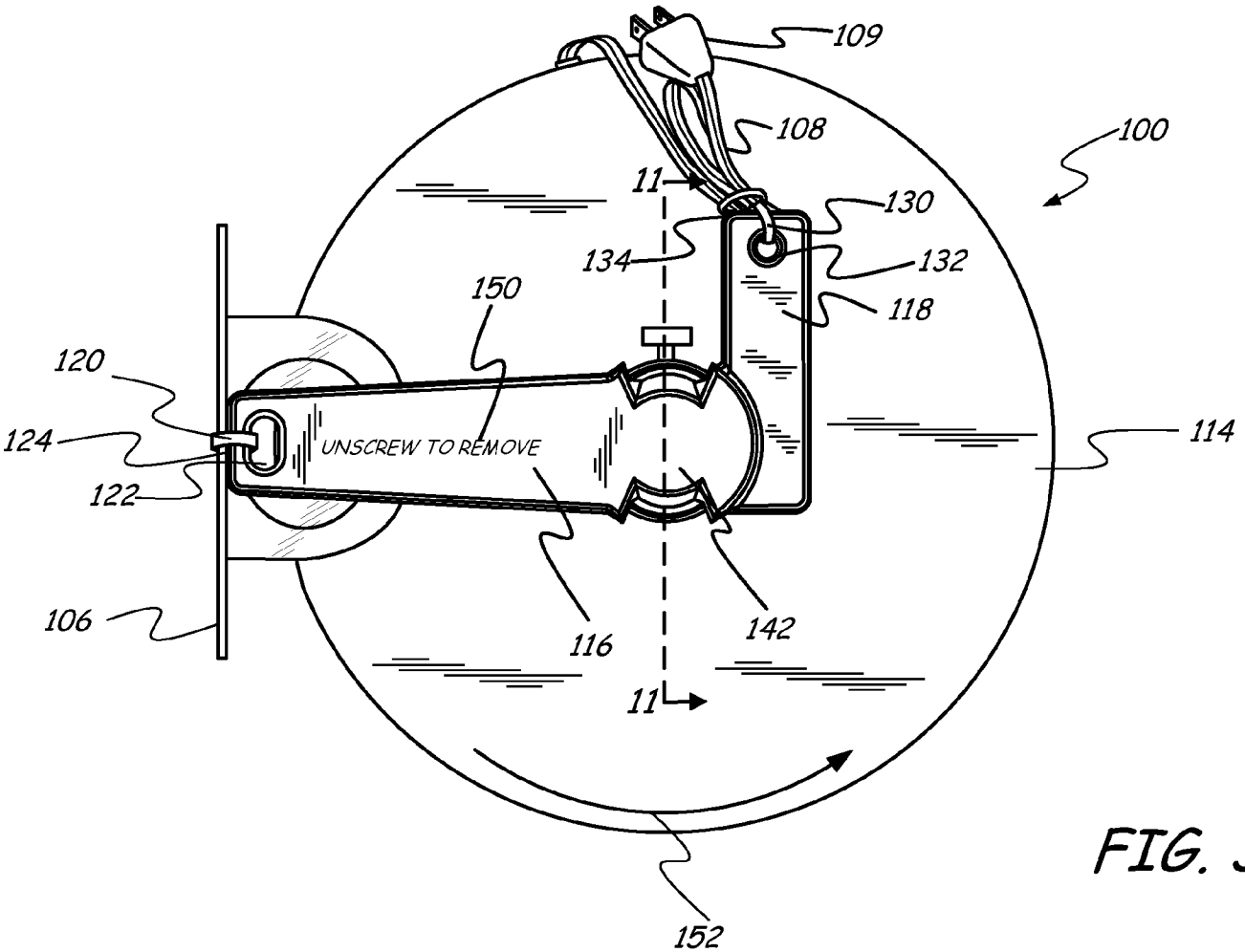
FIG. 3 is a top view of the lamp assembly with holding structure of FIG. 1.

FIGS. 1, 2 and 3 provide a front view, side view, and top view, respectively, of a lamp assembly 100. Lamp assembly 100 includes a base 114 that is connected to and supports a hollow pole 112. Base 114 is designed to contact a supporting surface and to keep lamp assembly 100 from tipping over. Pole 112 is attached to base 114 by being screwed into base 114 or by being welded to base 114, for example. Although pole 112 and base 114 are shown in FIGS. 1, 2, and 3 as being configured for a table lamp, those skilled in the art will recognize that the sizes of pole 112 and base 114 may be increased to produce a floor lamp. In addition, although a round base 114 and round pole 112 are shown in FIGS. 1-3, other shapes for base 114 and pole 112 may be used.

A lamp socket 104 is attached to the top of pole 112. Lamp socket 104 includes a cap 105, a shell 107 and a rotary arm 110. Cap 105 connects to pole 112, typically by screwing onto pole 112, for example. Cap 105 holds shell 107, which encases a socket interior (see FIG. 11). Through pole 112 and its connection to cap 105, base 114 is able to support lamp socket 104. Rotary arm 110 forms part of the socket interior and extends out through shell 107. Rotary arm 110 may be rotated to control a switch in the socket interior that places the lamp socket in different conducting states. In some embodiments, the states are simply "on" and "off." In other embodiments, the states are "off", low-wattage on, medium-wattage on, and high-wattage on. Rotary arm 110 may be replaced with a pull chain or a push-through arm.

The socket interior includes an insulating material as well as the switch, two power couplings, a set of conducting threads and a conducting base plate or spring that are mounted to or housed by the insulating material. The conducting threads are found on an interior cylindrical surface of the socket that defines an interior cylindrical space. The conducting base plate is found at the bottom of the interior cylindrical space. The conducting threads are electrically connected to one of the power couplings, which is attached or connected to a first wire of an electrical cord 108. The conducting base plate is electrically connected to a first pole of the switch. A second pole of the switch is electrically connected to the second power coupling, which is attached or connected to a second wire of electrical cord 108. To place the light in an "on" state, the switch connects the first pole to the second pole allowing current to flow between the conducting base plate and the power cord.

Electrical cord 108 extends from the two power couplings, through the interior of pole 112, within a space defined by base 114 and through an opening 115 in base 114. Electrical cord 108 terminates at an end with an electrical plug 109 having two prongs 111 and 113, with prong 111 connected to a first conducting wire in electrical cord 108 and prong 113 connected to a second conducting wire in electrical cord 108.

Lamp assembly 100 includes a holding structure 102 inserted in the interior cylindrical space of lamp socket 104. Holding structure 102 includes a socket portion or socket latching component 142, a first laterally extending arm or arm portion 116 extending from socket portion 142 and a second laterally extending arm or arm portion 118 extending from socket portion 142. Socket portion 142 engages with the conducting screw threads of lamp socket 104 to maintain holding structure 102 within lamp socket 104. Holding structure 102 may be removed by unscrewing holding structure 102 in a direction 152 (FIG. 3).

In accordance with one embodiment, holding structure 102 is formed of a plastic material such Low-Density Polyethylene (LDPE), however, those skilled in the art will recognize that other materials may be used in place of LDPE. In accordance with several embodiments, holding structure 102 is formed of a material with high resistivity (such as LDPE) so that electricity will not be conducted through the holding structure should electrical cord 108 of the lamp assembly be plugged into a power source while the holding structure is in lamp socket 104.

As shown in FIGS. 1-3, holding structure 102 supports or holds a lamp package 106. In such embodiments, holding structure 102 may alternatively be referred to as a lamp holder. In other embodiments, holding structure 102 may hold other items such as marketing signs or tags.

In FIGS. 1-3, lamp package 106 is connected or attached to arm 116 by a connector 120 that passes through a hole 122 (FIG. 3) in distal and 124 of arm 116 and passes through a hole 126 (FIG. 2) of lamp package 106. In FIGS. 1-3, connector 120 maintains lamp package 106 in close proximity to arm 116 to help limit movement of lamp package 106 relative to the remainder of lamp assembly 100. By limiting such movement, connector 120 reduces the chances that the lamp in lamp package 106 will strike another portion of lamp assembly 100 and thereby reduces the chances that the lamp in lamp package 106 will break before lamp assembly 100 is purchased.

Lamp package 106 includes at least one lamp 160 designed to operate in the lamp socket. Lamp 160 is surrounded, at least in part, by packaging 162 that can include a paper backing 163 having printed material thereon, and a plastic shell 164 that encases at least a portion of lamp 160 and either encases paper backing 163 or is adhered to paper backing 163.

At a distal end 134 of arm 118 opposite from socket portion 142, a connector 130 connects or attaches electrical cord 108 to holding structure 102. Connector 130 passes through a hole 132 (FIG. 3) in arm 118 and extends around a portion 136 of electrical cord 108. As shown in FIGS. 1-3, electrical cord 108 is coiled or folded and connector 120 extends around multiple portions of electrical cord 108. Although shown folded in one configuration in FIGS. 1-3, those skilled in the art will recognize that other folding or coiling techniques can be used before connecting electrical cord 108 to holding structure 102.

Connectors 120 and 130 can be made of wire, paper-covered wire, plastic, or any other suitable material. In accordance with one embodiment, connectors 120 and 130 are cable ties that must be cut to be removed.

In the embodiment shown in FIG. 3, holding structure 102 includes a legend 150 that provides an instruction to unscrew holding structure 102 to remove it from lamp socket 104. In accordance with some embodiments, legend 150 is molded into holding structure 102. In other embodiments, this legend is printed directly on holding structure 102 or on a label adhered to holding structure 102.

FIGS. 4-9 provide a top view, a bottom view, a left side view, a right side view, a front view, and a back view, respectively, of holding structure 102.

Figure 4:
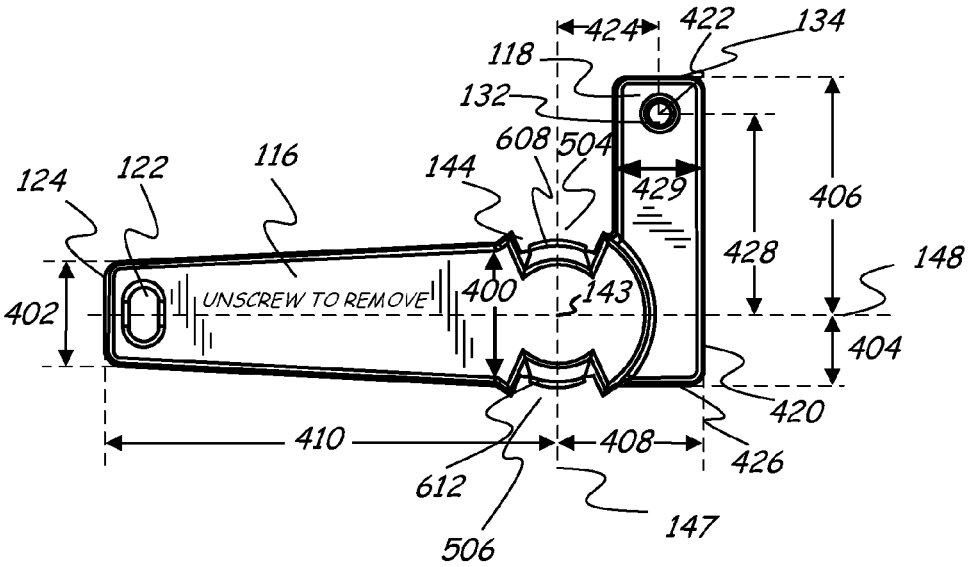
FIG. 4 is a top view of the holding structure.
Figure 5:
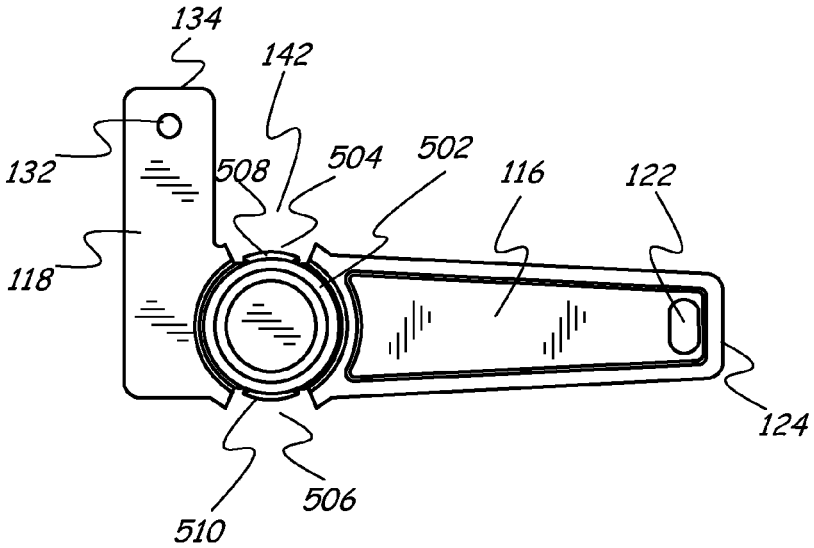
FIG. 5 is a bottom view of the holding structure.

In FIG. 4, socket portion 142 has a center 143 defined at an intersection of a first axis 148 and a second axis 147. First axis 148 bisects arm 116 and socket portion 142. Second axis 147 is orthogonal to first axis 148 at center 143 and bisects socket portion 142.

Distal end 124 of arm 116 is a distance 410 from second axis 147 of socket portion 142. In other words, arm 116 has a length 410 from center 143 of socket portion 142 to distal end 124. In accordance with one embodiment, distance 410 is 3.00 inches (76.20 mm). A side edge 420 of arm 118 is located a distance 408 from second axis 147 in a direction opposite to distal end 124. In accordance with one embodiment, distance 408 is 0.980 inches (24.88 mm). A center 422 of opening 132 is located a distance 424 from second axis 147 in a direction opposite to distal end 124. In accordance with one embodiment, distance 424 is 0.677 inches (17.20 mm).

Distal end 134 of arm 118 is located a distance 406 from first axis 148. In other words, arm 118 has a length 406 from center 143 of socket portion 142 to distal end 134. In accordance with one embodiment, distance 406 is 1.589 inches (40.35 mm). A proximal end 426 of arm 118 is located a distance 404 from first axis 148 in a direction opposite from distal end 134. In accordance with one embodiment, distance 404 is 0.406 inches (10.32 mm). Center 422 of opening 132 is located a distance 428 from first axis 418. In accordance with one embodiment, distance 428 is 1.339 inches (34 mm).

In FIGS. 4-9, arm 116 is shown to be tapered with a width 400 next to socket portion 142 that is greater than a width 402 at distal end 124. Arm 118 is shown to have a width 429 in the portion of arm 118 that extends away from socket portion 142.

Figure 8:
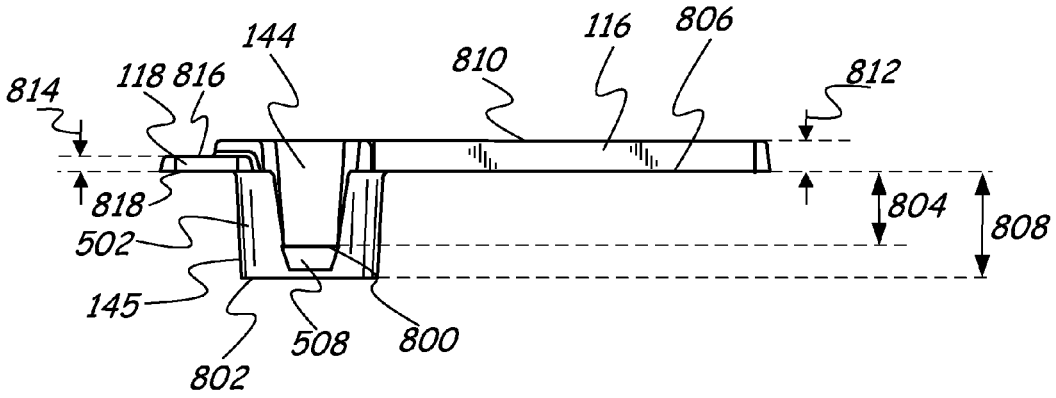
FIG. 8 is a front view of the holding structure.

In FIG. 8, arm 116 is shown to have a thickness 812 from a top 810 to a bottom 806 of arm 116. In accordance with one embodiment, thickness 812 is 0.200 inches (5.08 mm). Arm 118 is shown to have a thickness 814 from a top 816 to a bottom 818 of arm 118. In accordance with one embodiment, thickness 814 is 0.098 inches (2.5 mm). As shown in FIG. 8, arm 118 is thinner than arm 116. By making arm 118 thinner than arm 116, the total weight of holding structure 102 is less than if arm 118 was the same thickness as arm 116. This reduction in weight is important since the weight of the holding structure affects the shipping cost of the lamp assembly.

In FIGS. 1-9, arm 118 has a length 406 that is shorter than length 410 of arm 116. The added length of arm 116 is provided to allow enough room for lamp package 106 to extend below arm 116 without being in contact with socket 104 or pole 112, while the shorter length of arm 118 reduces torque on holding structure 102 and reduces the weight of holding structure 102.

Figure 6:
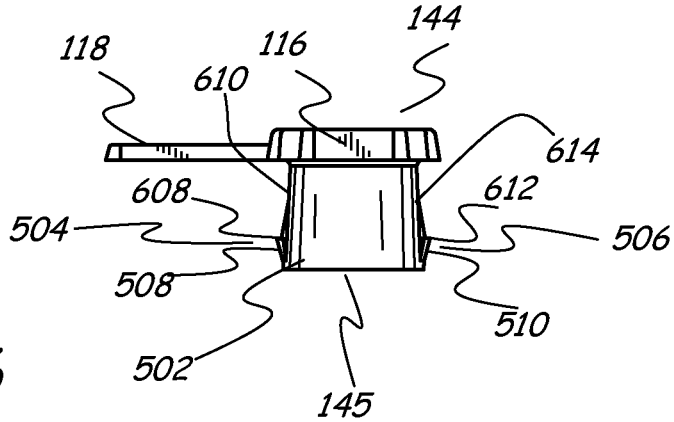
FIG. 6 is a left side view of the holding structure.
Figure 7:
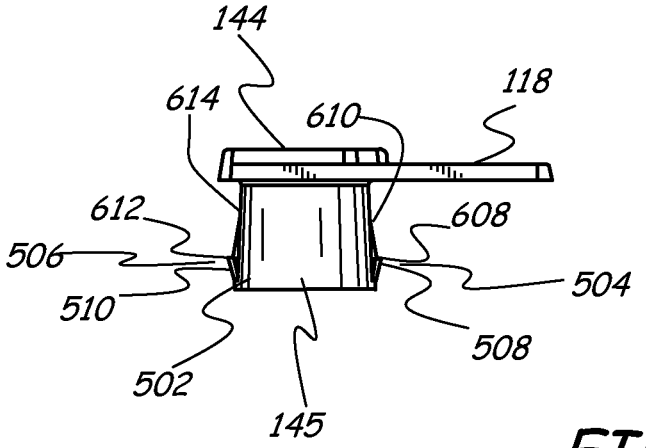
FIG. 7 is a right side view of the holding structure.

As shown in FIGS. 6-9, socket portion 142 includes an upper part 144 from which arms 116 and 118 extend laterally and a lower part 145, which is designed to be inserted within lamp socket 104. Lower part 145 of socket portion 142 includes a sleeve 502 having protrusions 504 and 506 extending outwardly therefrom and an outer perimeter defined along the outer surface of sleeve 502. In accordance with one embodiment, protrusions 504 and 506 are localized such that they do not extend around the entire outer perimeter of sleeve 502. Protrusion 504 comprises a lower planar surface 508 and an upper planar surface 608 (FIG. 6). In accordance with one embodiment, lower planar surface 508 extends out at a small angle from a wall 610 of sleeve 502 and upper planar surface 608 is substantially horizontal, where horizontal is defined to be parallel to a plane that arm 116 laterally extends along. Thus, upper planar surface 608 extends out at a much larger angle to wall 610 than lower planar surface 508. The difference in orientation of planar surfaces 508 and 608 makes it easier to press holding structure 102 into lamp socket 104 than to pull holding structure 102 out of lamp socket 104. Protrusion 506 includes a lower planar surface 510 and an upper planar surface 612. In accordance with one embodiment, lower planar surface 510 is at a small angle to a wall 614 of sleeve 502 and planar surface 612 is substantially horizontal. Thus, upper planar surface 612 extends out at a much larger angle to wall 614 than lower planar surface 510. The difference in orientation between lower planar surface 510 and upper planar surface 612 makes it easier to press holding structure 102 into lamp socket 104 than to pull holding structure 102 out of lamp socket 104.

Figure 9:
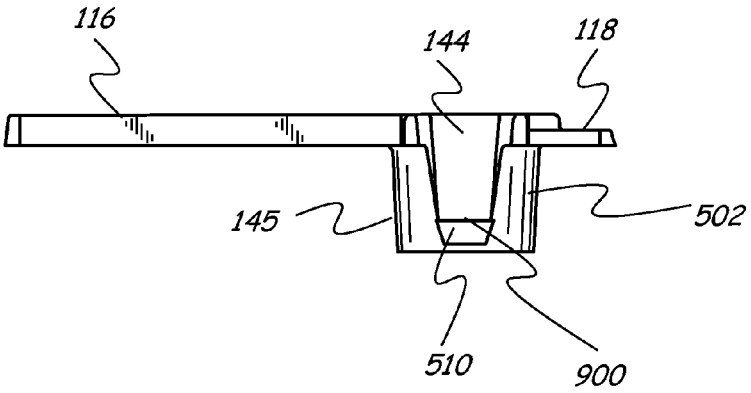
FIG. 9 is a back view of the holding structure.

As shown in FIGS. 8 and 9, lower planar surface 508 and upper planar surface 608 join together at an edge 800 while lower planar surface 510 and upper planar surface 612 join at an edge 900. Edge 800 is located a distance 804 from bottom 806 of arm 116. In accordance with one embodiment, distance 804 is 0.500 inches (12.70 mm). A bottom edge 802 of sleeve 502 is located a distance 808 from bottom 806 of arm 116. In accordance with one embodiment, distance 808 is 0.700 inches (17.78 mm).

Figure 10:
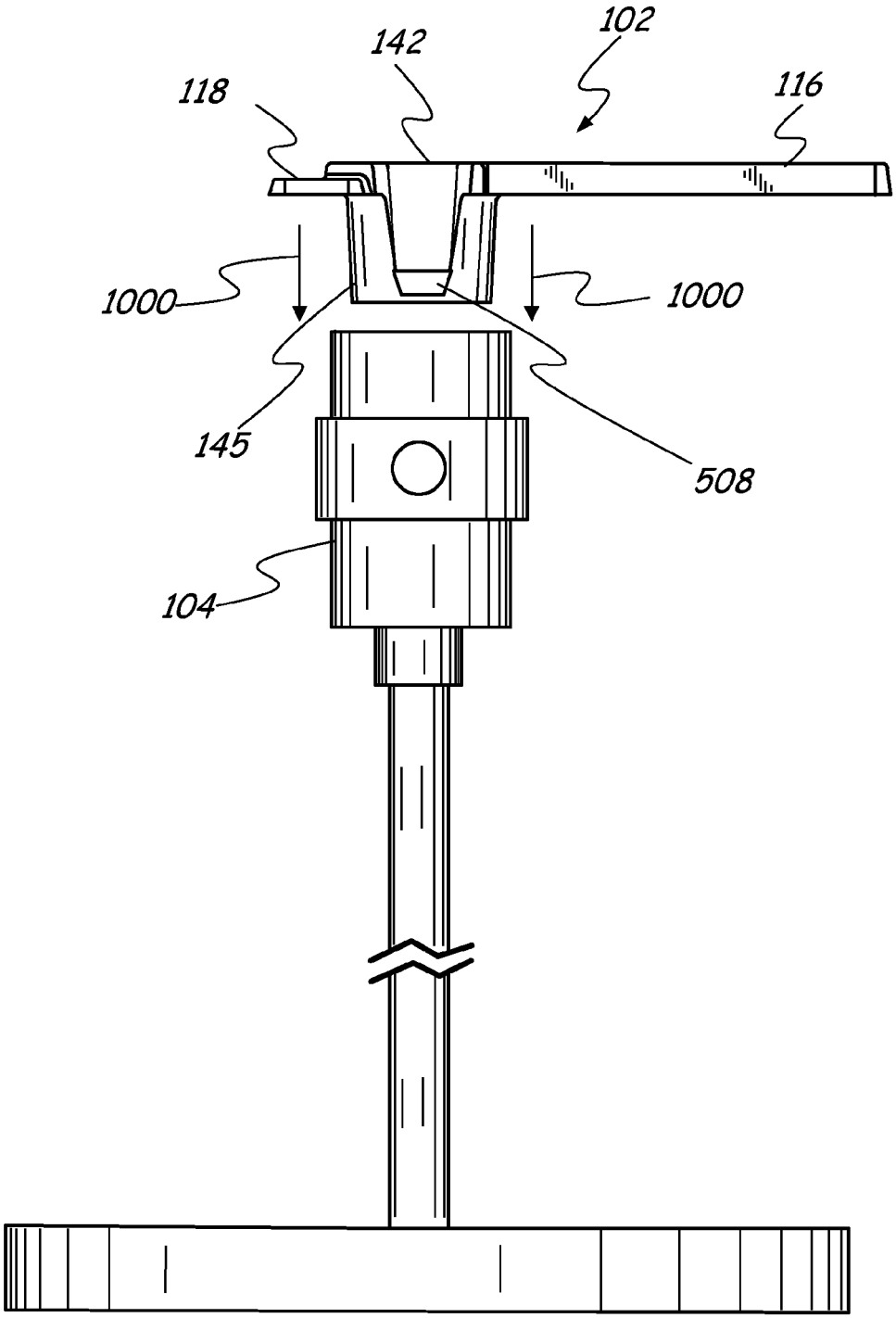
FIG. 10 is a front view of the lamp assembly and holding structure showing the insertion of the holding structure.

FIG. 10 shows a front view of lamp assembly 100 showing holding structure 102 being inserted into lamp socket 104. In FIG. 10, lower part 145 of socket portion 142 is shown being pressed into lamp socket 104 in a vertical direction 1000. As lower part 145 is pressed into lamp socket 104, lower planar walls 508 and 510 engage and slide past screw threads within lamp socket 104 causing lower part 145 to flex such that planar surface 508 and 510 move toward the center of lamp socket 104 thereby allowing edges 800 and 900 to move below the screw threads of the interior of lamp socket 104. As edges 800 and 900 move below a thread, lower part 145 expands once again so that edges 800 and 900 contact the interior surface of lamp socket 104.

Being able to press holding structure 102 into lamp socket 104 allows holding structure 102 to be inserted quickly into lamp socket 104 at a desired orientation to lamp socket 104. In particular, arm 116 can be positioned such that it points out horizontally from lamp socket 104 in a particular angular direction.

Figure 11:
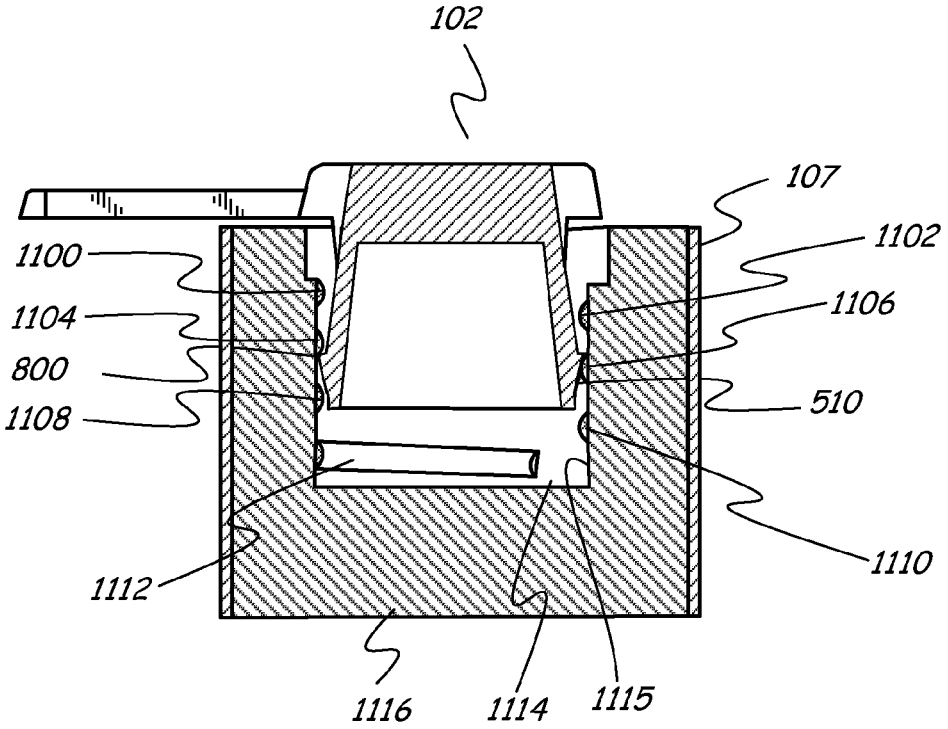
FIG. 11 is a cross-sectional side view of the socket and holding structure.

FIG. 11 shows a cross-section of holding structure 102 and a top portion of lamp socket 104 from a side view as indicated in FIG. 3. In FIG. 11, electrical cord 108 and connector 130 have not been included.

In FIG. 11, lamp socket 104 is shown to include screw threads 1100, 1102, 1104, 1106, 1108, 1110, and 1112 in an interior space 1114 defined by a cylindrical inner surface 1115 of socket interior 1116. Socket interior 1116 is encased by shell 107.

In FIG. 11, edge 800 of holding structure 102 is shown positioned immediately below thread 1104 and engages the underside of thread 1104 and inner surface 1115 between thread 1104 and thread 1108. Planar surface 510 is shown engaging thread 1106. The friction between thread 1106 and planar surface 510 and between edge 800 and thread 1104 maintains holding structure 102 within socket 104. The interaction between edge 800 and the threads and between planar surface 510 and the threads also allows holding structure 102 to be unscrewed from lamp socket 104.

Figure 12:
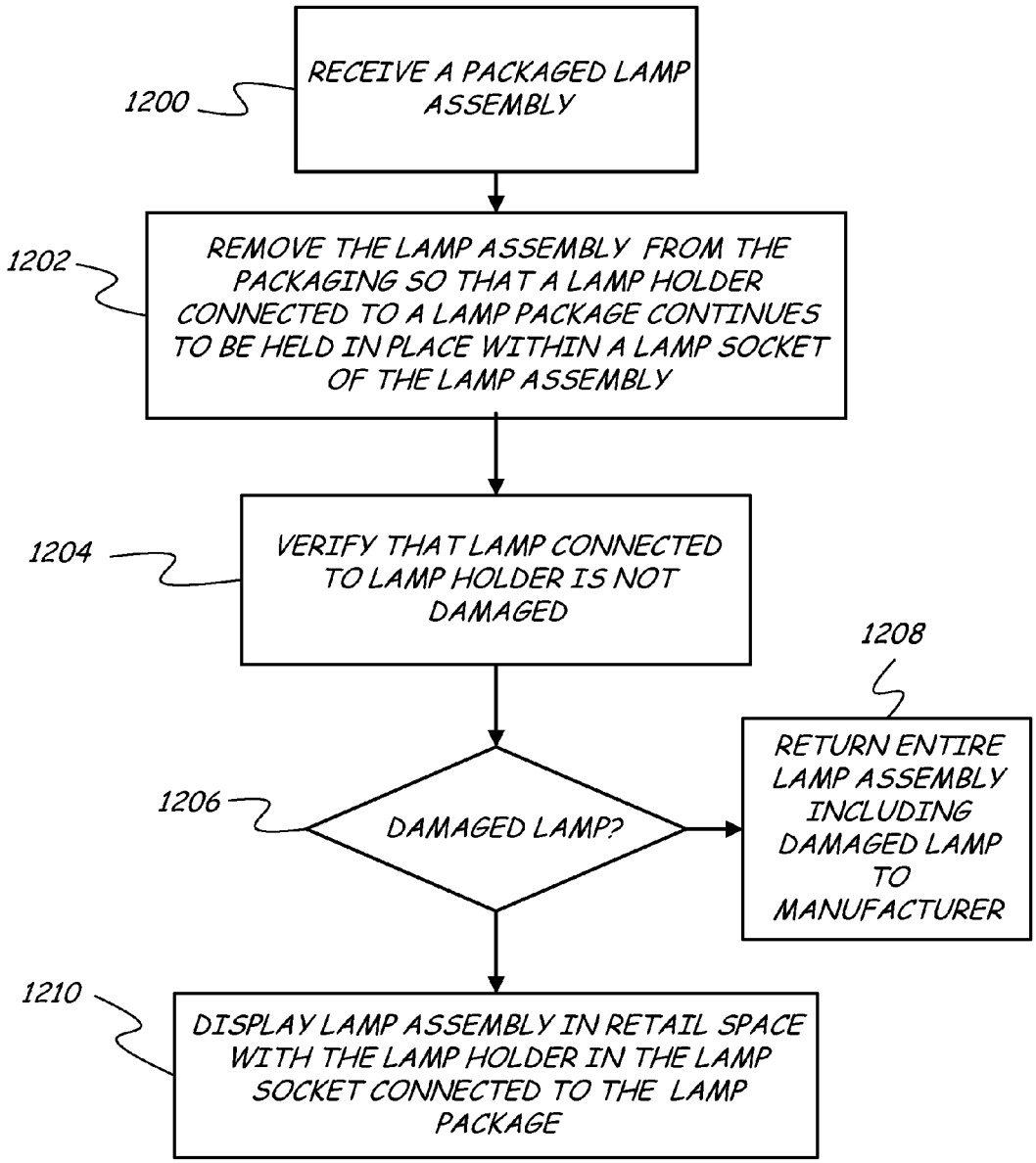
FIG. 12 is a flow diagram of a method of un-packaging and displaying a lamp assembly with a holding structure.

FIG. 12 provides a flow diagram of a method of handling a lamp assembly. In step 1200, a packaged lamp assembly is received at a retail store. The packaged lamp assembly consists of packaging surrounding a lamp assembly, where the lamp assembly includes a lamp base, a lamp socket, a lamp holder inserted in the lamp socket, and a lamp package connected to the lamp holder and the packaging includes an exterior box and possibly one or more cushioning elements such as foam pieces, foam pellets, paper and the like.

At step 1202 the lamp assembly is removed from the packaging so that a lamp holder connected to a lamp package continues to be held in place within a lamp socket of the lamp assembly. In accordance with some embodiments, removing the lamp assembly from the packaging includes opening the box, breaking connections between the box and the lamp assembly and removing cushioning material from around the lamp assembly. Note that the lamp package, typically a packaged light bulb, remains intact and connected to the lamp holder even after the lamp assembly has been removed from the packaging. Thus, the lamp in the lamp package continues to be protected by its packaging after step 1202.

At step 1204, the lamp package is inspected to verify that the lamp it contains is not damaged. If the lamp, often referred to as a light bulb, is damaged at step 1206, the entire lamp assembly including the damaged lamp is returned to the manufacturer at step 1208. If the lamp package is not damaged at step 1206, the lamp assembly is displayed in the retail space with the lamp holder in the lamp socket and the lamp package connected to the lamp holder at step 1210.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A lamp assembly comprising:

a base;

a lamp socket, supported by the base, the lamp socket having a cylindrical inner surface with screw threads formed thereon;

a lamp holder having a socket portion and an arm portion, a lower part of the socket portion being inserted within the lamp socket and held in place by the screw threads of the lamp socket, the arm portion extending laterally from an upper part of the socket portion;

a lamp package comprising a lamp at least partially encased in packaging, the lamp package being attached to the arm portion of the lamp holder.

2. The lamp assembly of claim 1 wherein the lamp holder further comprises a second arm portion extending laterally from the upper part of the socket portion.

3. The lamp assembly of claim 2 further comprising an electrical cord extending through a part of the base and connecting to the lamp socket, the electrical cord having an end with an electrical plug.

4. The lamp assembly of claim 3 wherein a portion of the electrical cord is attached to the second arm portion.

5. The lamp assembly of claim 2 wherein the arm portion has a first length from a center of the socket portion to a distal end of the arm portion, and wherein the second arm portion has a second length from the center of the socket portion to a distal end of the second arm portion, and wherein the first length is longer than the second length.

6. The lamp assembly of claim 1 wherein the lower part of the socket portion comprises at least one protrusion that engages with at least one screw thread of the socket.

7. The lamp assembly of claim 6 wherein the lower part of the socket portion is formed such that the lower part of the socket portion can be pushed into the socket instead of being screwed into the socket.

8. The lamp assembly of claim 7 wherein the at least one protrusion extends around less than an entire outer perimeter of the lower part of the socket portion.

9. The lamp assembly of claim 6 wherein the lower part of the socket portion is formed such that the lower part of the socket portion can be unscrewed from the socket.

10. The lamp assembly of claim 6 wherein the at least one protrusion comprises two planar surfaces.

11. A lamp holder comprising:

a socket latching component shaped to be pressed into a lamp socket such that threads within the lamp socket hold the socket latching component in place;

an arm extending from the socket latching component, the arm being capable of supporting a lamp package containing a lamp designed to operate in the lamp socket.

12. The lamp holder of claim 11 wherein the arm comprises a distal end having a hole designed to receive a connector for connecting the lamp holder to the lamp package.

13. The lamp holder of claim 11 wherein the socket latching component comprises two planar areas that join at an edge that contacts a surface between two threads within the lamp socket.

14. The lamp holder of claim 11 wherein the socket latching component is further shaped to be unscrewed from the lamp socket.

15. The lamp holder of claim 11 wherein the lamp holder further comprises a second arm for supporting an electrical cord.

16. The lamp holder of claim 15 wherein the second arm comprises a distal end having a hole designed to receive a connector for connecting the second arm to the electrical cord.

17. A method comprising:

receiving a packaged lamp assembly comprising packaging around at least a portion of a lamp assembly;

removing the lamp assembly from the packaging of the packaged lamp assembly, the lamp assembly comprising a lamp base, a lamp socket, a lamp holder inserted in the lamp socket, and a lamp package, wherein the lamp holder comprises at least one arm and the lamp package is connected to at least one arm of the lamp holder; and displaying the lamp assembly in a retail space while maintaining the connection between the lamp package and the arm of the lamp holder so that the lamp assembly, including the lamp package, may be purchased.

18. The method of claim 17 wherein the lamp holder is engaged with the lamp socket such that the lamp holder is designed to be unscrewed from the lamp socket.

19. The method of claim 17 wherein the lamp assembly further comprises an electrical cord and wherein a second arm of the lamp holder is connected to the electrical cord.

20. The method of claim 17 wherein the lamp holder further comprises instructions for unscrewing the lamp holder from the lamp socket.

* * * * *